US009731303B2

(12) United States Patent
Harris et al.

(10) Patent No.: US 9,731,303 B2
(45) Date of Patent: Aug. 15, 2017

(54) OSCILLATING NOZZLES

(71) Applicant: Hydra-Flex, Inc., Burnsville, MN (US)

(72) Inventors: Jaime L. Harris, Rosemount, MN (US); Bryan Flood, Minneapolis, MN (US)

(73) Assignee: Hydra-Flex, Inc., Burnsville, MN (US)

( * ) Notice: Subject to any disclaimer, the term of this patent is extended or adjusted under 35 U.S.C. 154(b) by 86 days.

(21) Appl. No.: 14/674,626

(22) Filed: Mar. 31, 2015

(65) Prior Publication Data

US 2015/0273489 A1 Oct. 1, 2015

Related U.S. Application Data

(60) Provisional application No. 61/972,739, filed on Mar. 31, 2014.

(51) Int. Cl.

| | |
|---|---|
| ***B05B 1/34*** | (2006.01) |
| ***B05B 1/08*** | (2006.01) |
| ***B05B 3/16*** | (2006.01) |
| ***B05B 3/04*** | (2006.01) |

(52) U.S. Cl.

CPC ..... *B05B 1/083* (2013.01); *B05B 3/0463* (2013.01); *B05B 3/16* (2013.01)

(58) Field of Classification Search

CPC ..... B05B 1/083; B05B 3/0463; B05B 3/16
USPC ..... 239/487, 489, 240
See application file for complete search history.

(56) References Cited

U.S. PATENT DOCUMENTS

| | | | | |
|---|---|---|---|---|
| 4,069,976 | A | 1/1978 | Chauvigné | |
| 4,253,608 | A | 3/1981 | Hunter | |
| 5,098,021 | A | 3/1992 | Kah, Jr. | |
| 6,273,512 | B1 | 8/2001 | Rajewski | |
| 6,460,734 | B1 * | 10/2002 | Schroeder | B67D 1/0021 222/129.1 |
| 8,500,042 | B2 | 8/2013 | Brown et al. | |
| 8,544,567 | B2 * | 10/2013 | Comeau | E21B 7/24 175/297 |
| 2001/0054515 | A1 * | 12/2001 | Eddison | E21B 4/02 175/56 |
| 2003/0209611 | A1 * | 11/2003 | Harris | B05B 3/0463 239/251 |
| 2012/0018218 | A1 * | 1/2012 | Rosenhauch | E21B 4/02 175/24 |
| 2013/0025169 | A1 | 1/2013 | McCarty et al. | |
| 2014/0042245 | A1 | 2/2014 | Buckner | |

* cited by examiner

*Primary Examiner* — Arthur O Hall
*Assistant Examiner* — Joel Zhou
(74) *Attorney, Agent, or Firm* — Dorsey & Whitney LLP

(57) ABSTRACT

An oscillating spray nozzle and related methods for providing spray patterns in a variety of oscillating patterns by driving movement of the nozzle with a progressing cavity displacement motor. By varying the design of the progressing cavity displacement motor, a variety of spray pattern geometries can be generated and a speed of the nozzle as it travels through the spray pattern geometries can be controlled. The oscillating spray nozzle can include a housing enclosing a progressing cavity motor that is operably connected to a spray nozzle. The progressing cavity motor includes a rotor member that is caused to rotate and oscillate within a stator member. The rotor member is operably linked to the spray nozzle, whereby the movement of the rotor member is communicated to the spray nozzle.

22 Claims, 11 Drawing Sheets

132
210
124
132
130

210
124
132
130

132
210
124
132
130

132
210
124
130
132

132

1/2
210

2/3

3/4

4/5

OSCILLATING NOZZLES

RELATED APPLICATION

The present application claims the benefit of U.S. Provisional Application No. 61/972,739 filed Mar. 31, 2014, which is incorporated herein in its entirety by reference.

FIELD OF THE INVENTION

The present invention is directed to spray nozzles. More specifically, the present invention is directed to oscillating spray nozzles and their associate methods of use so to provide for reliable operation and spray pattern as well as consistent oscillation speed.

BACKGROUND OF THE DISCLOSURE

Spray nozzles are used in a wide variety of applications and industries. Representative uses can include in car washes, hydro excavation and just about any industry involving cleaning and sanitation. Spray nozzles can be attached to movable mechanical systems to expand spray coverage. Alternatively, the nozzles themselves can provide for expanded spray coverage, for example, through the use of rotary spray nozzles that spin and provide a continually rotating spray pattern.

While it is well known to utilize mechanical mounting systems and rotary spray nozzles to expand spray coverage, to date there has not been a consistent and reliable nozzle design that allows a nozzle to provide other spray patterns beyond rotary patterns. For example, spray nozzles that provide for a consistent and reliable linear spray pattern that would be especially beneficial in hydroexcavation applications are to date unavailable. As such, it would be advantageous to have a spray nozzle design that is capable of providing non-rotary spray patterns in a reliable and consistent fashion.

SUMMARY OF THE DISCLOSURE

An oscillating spray nozzle of the present invention is capable of providing spray patterns in a variety of oscillating patterns by driving movement of the nozzle with a progressing cavity displacement motor. By varying the design of the progressing cavity displacement motor, a variety of spray pattern geometries can be generated and a speed of the nozzle as it travels through the spray pattern geometries can be controlled. In one representative embodiment, the oscillating spray nozzle provides for a linear spray pattern that can be especially beneficial in hydroexcavation applications. Alternatively, the oscillating spray nozzle can provide for a number of alternative spray patterns that can be specifically tailored to applications, for example, in car washes to apply wash chemicals and rinsing agents.

In one aspect of the present invention, an oscillating spray nozzle comprises a housing defining a fluid inlet and a spray outlet. The housing generally defined an internal motor section proximate the fluid inlet and an internal nozzle section proximate the spray outlet. The internal motor section generally includes a progressing cavity motor that is fluidly connected to the fluid inlet, while the internal nozzle section includes a spray nozzle fluidly connected to the spray outlet. The progressing cavity motor generally comprises a rotor member and a stator member, wherein the rotor is caused to spin and oscillate within the stator member in direct response to fluid flow through the rotor that is introduced through the fluid inlet. A bearing assembly can operably link the rotor to the spray nozzle such that the motion imparted to the rotor within the progressing cavity motor is transferred and translated to the spray nozzle. As the fluid flow exits the rotor, the fluid flow enters the spray nozzle and subsequently exits the spray nozzle at the spray outlet in a spray pattern matching that of the motion imparted to the spray nozzle form the rotor. By varying the arrangement of the rotor member and the stator member, different spray patterns can be imparted to the spray nozzle. For instance, the rotor member can include one lobe while the stator member can comprise two cavities to create a ½ progressing cavity motor having a linear, back and forth, oscillating spray pattern. Other embodiments can comprise other arrangements of rotor lobes and stator cavities to provide spray patterns with other geometric spray patterns.

In another aspect of the present invention, a method of controlling a nozzle spray pattern can comprise coupling a spray nozzle to a rotor member of a progressing cavity motor. The method can further comprise providing an inlet flow to the progressing cavity motor, whereby the rotor member is caused to spin within a stator member such that the motion imparted to the rotor member is transferred/translated to the spray nozzle. The method can further comprise selecting a lobe configuration for the rotor member and a cavity configuration for the stator member so as to impart a desired motion to the rotor member that is subsequently communicated to the spray nozzle. The method can further comprise spraying a fluid spray from the nozzle, where the fluid spray has a spray pattern that is imparted by the interaction of the spray nozzle and the rotor member. The method can further comprises controlling an oscillating speed of the spray pattern by varying flow conditions of the inlet flow to the progressing cavity motor.

In yet another aspect, the present invention can be directed to a hydroexcavation system that comprises a fluid source and a spray nozzle that is operably coupled to a progressing cavity motor.

In yet another aspect, the present invention can be directed to a car wash system that comprises a fluid source and a spray nozzle that is operably coupled to a progressing cavity motor.

As used throughout the present disclosure, the term "motor" as used, for example, as used in the term "progressing cavity motor", is intended simply to refer to a device that creates motion through the interaction of a rotor member and a stator member.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF FIGURES

The invention can be completely understood in consideration of the following detailed description of various embodiments of the invention in connection with the accompanying drawings, in which.

Figure 1:
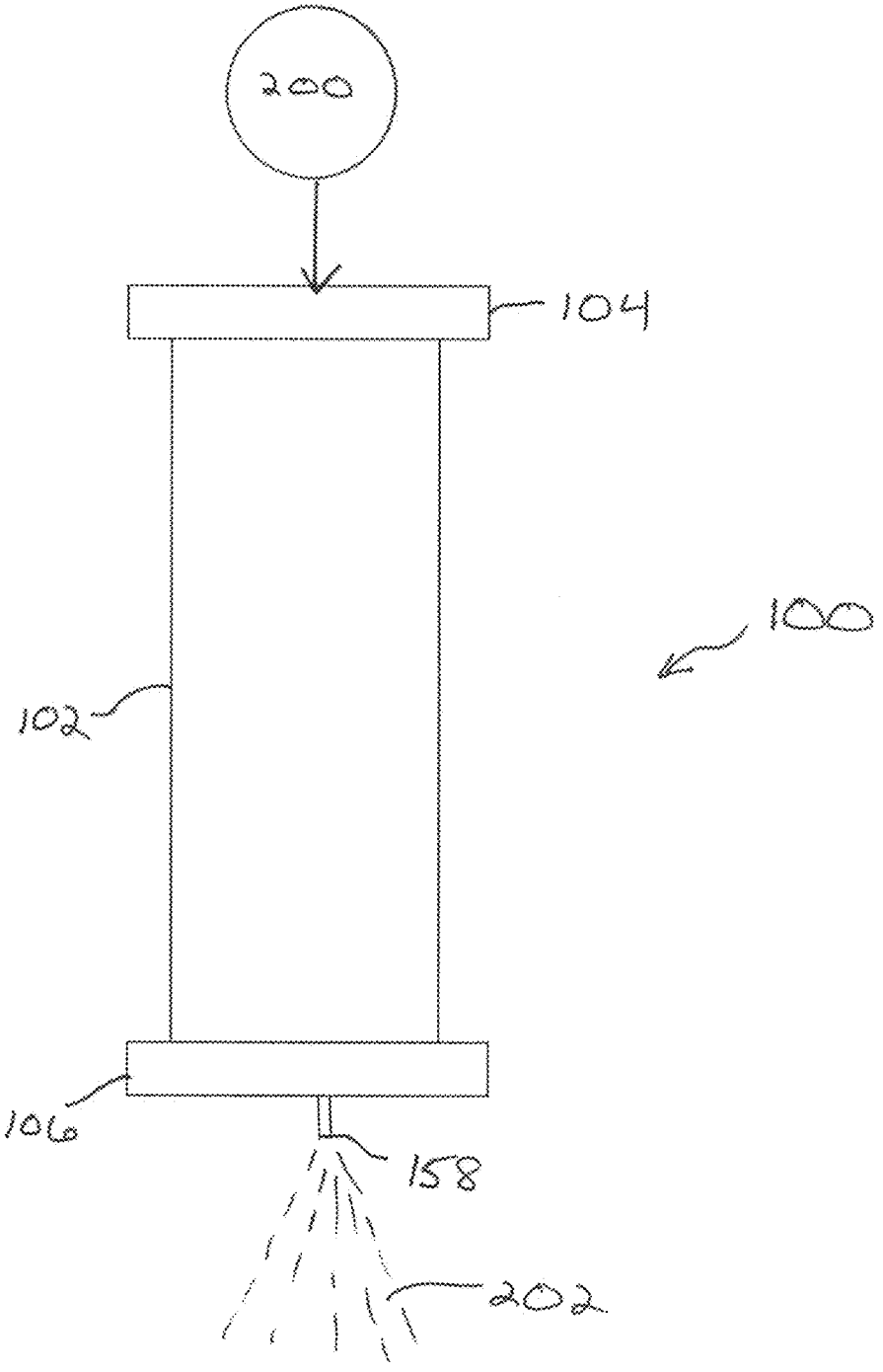
FIG. 1 is a side view of an oscillating spray nozzle according to a representative embodiment of the present invention.
Figure 2:
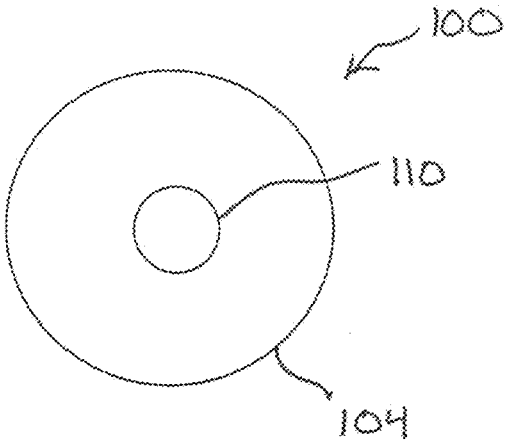
FIG. 2 is an end view of an inlet end of the oscillating spray nozzle of FIG. 1.
Figure 3:
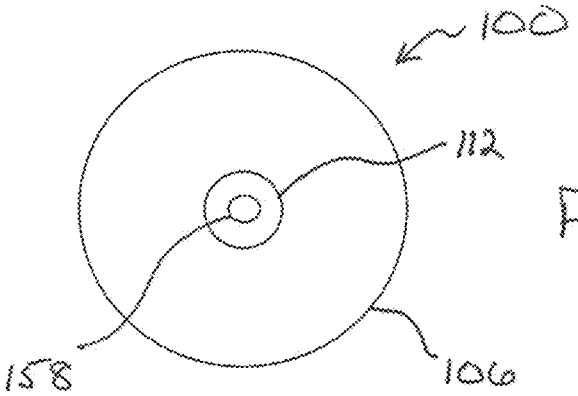
FIG. 3 is an end view of an outlet end of the oscillating spray nozzle of FIG. 1.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF FIGURES

Referring generally to FIGS. 1, 2, 3, 4, 5, 6 and 7, an oscillating spray nozzle 100 according to an embodiment of the present invention generally comprise a housing 102 having an inlet cap 104 and an outlet cap 106 to thereby define an interior portion 108. Inlet cap 104 and outlet cap 106 can be permanently or releasably attached to the housing 102, for example, using a conventional threaded connection. Inlet cap 104 includes a fluid inlet 110 providing for connection to a fluid source. Fluid inlet 110 can comprise any of a variety of connections including a conventional threaded connection or alternatively, commercially available quick-connect style connections for connection to the fluid source. Outlet cap 106 can define an outlet aperture 112.

Housing 102, inlet cap 104 and outlet cap 106 can be fabricated of material suitable for the operating conditions, i.e., operational flow rates, temperature, pressure, chemical compatibility and the like, or based on environmental conditions at a point of use. In some instance, housing 102, inlet cap 104 and outlet cap 106 can be fabricated of metallic materials such as, for example, stainless steel, aluminum, titanium and the like or ceramic and/or polymeric materials such as, for example, polyethylene, PEEK, PTFE, PVDF and the like. In some embodiments, housing 102 can be fabricated for low pressure operation, for example, operation under 200 psi as is commonly found in the car wash and sanitation markets. In some embodiments, housing 102 can be fabricated for operation at pressures of 200-1,500 psi as is commonly found in cleaning industries. In some embodiments, housing 102 can be fabricated for operation as high as 10,000-100,000 psi as found in the hydroexcavation and cutting industries.

As illustrated in FIGS. 4, 5, 6 and 7, interior portion 108 defines a motor section 120 and a nozzle section 122. Mounted within the motor section 120 is a progressing cavity motor 124 that is fluidly connected to the fluid inlet 100. Mounted within the nozzle section 122 is a spray nozzle 126 that is fluidly connected to the outlet aperture 112. Progressing cavity 124 and spray nozzle 126 are mechanically interconnected as will be further described.

Figure 4:
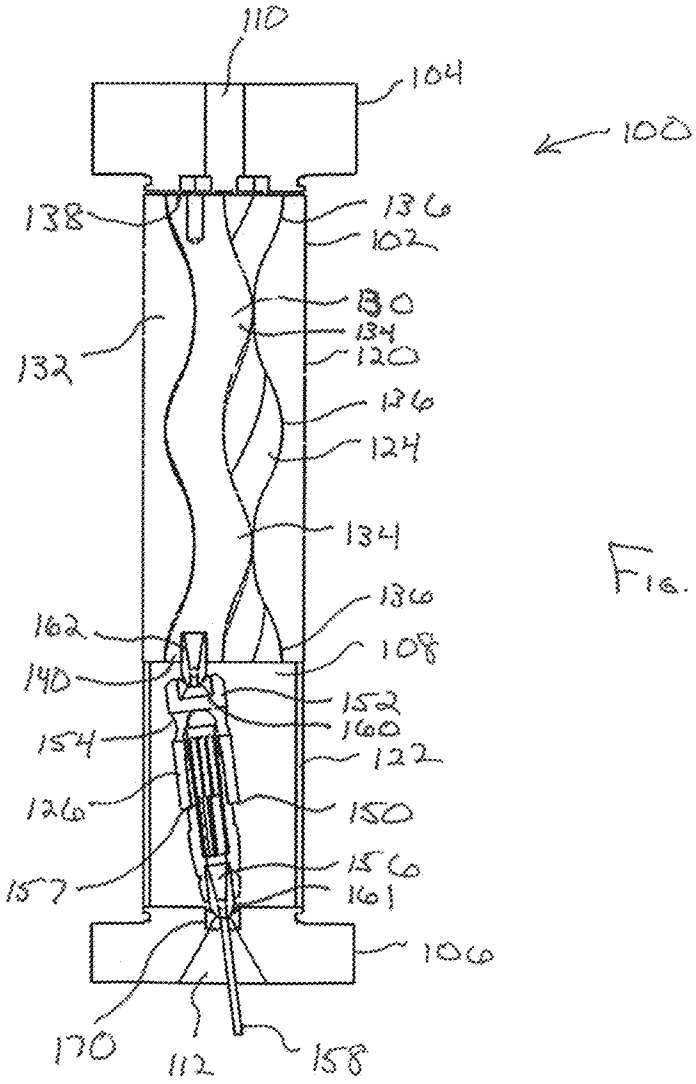
FIG. 4 is a section view of the oscillating spray nozzle of FIG. 1.
Figure 5:
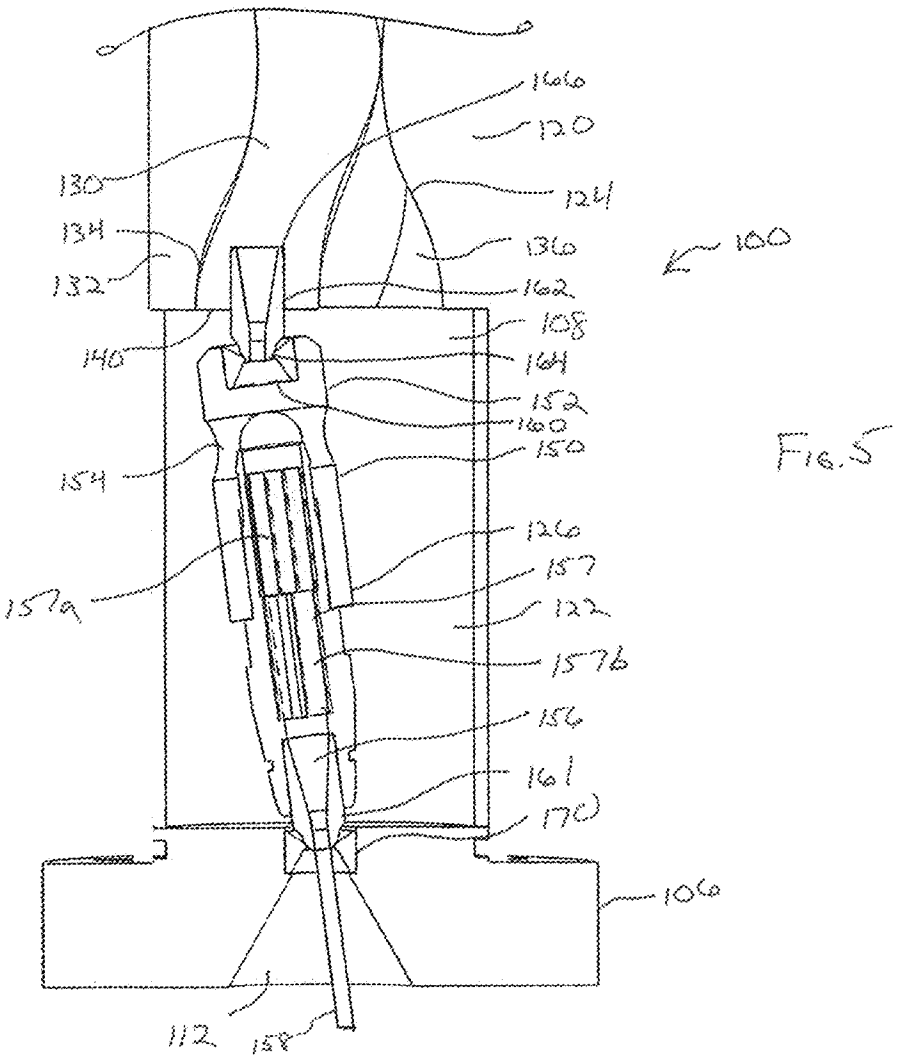
FIG. 5 is a partially hidden, section view of an outlet end of the oscillating spray nozzle of FIG. 1.
Figure 6:
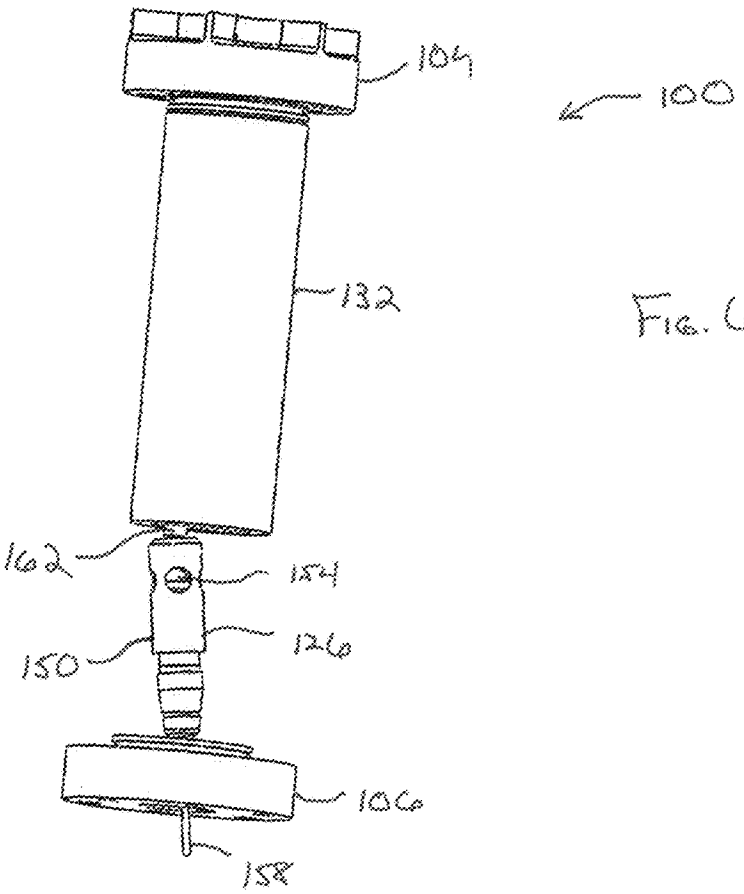
FIG. 6 is a partially hidden, side view of the oscillating spray nozzle of FIG. 1.
Figure 7:
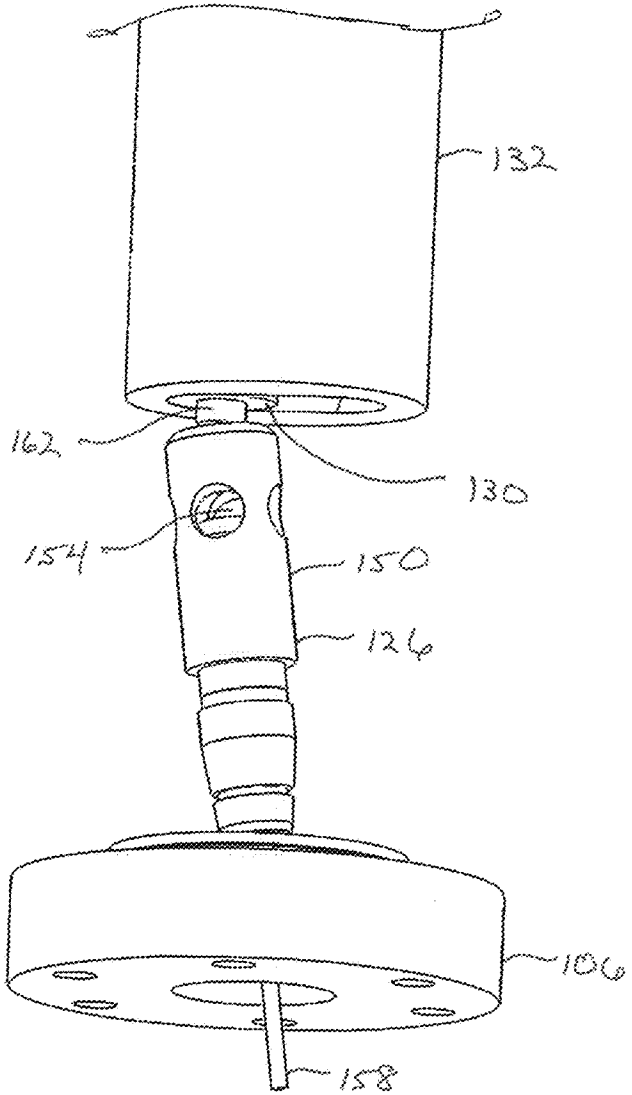
FIG. 7 is a partially hidden, side view of an outlet end of the oscillating spray nozzle of FIG. 1.
Figures 8A, 8B, 8C, 8D:
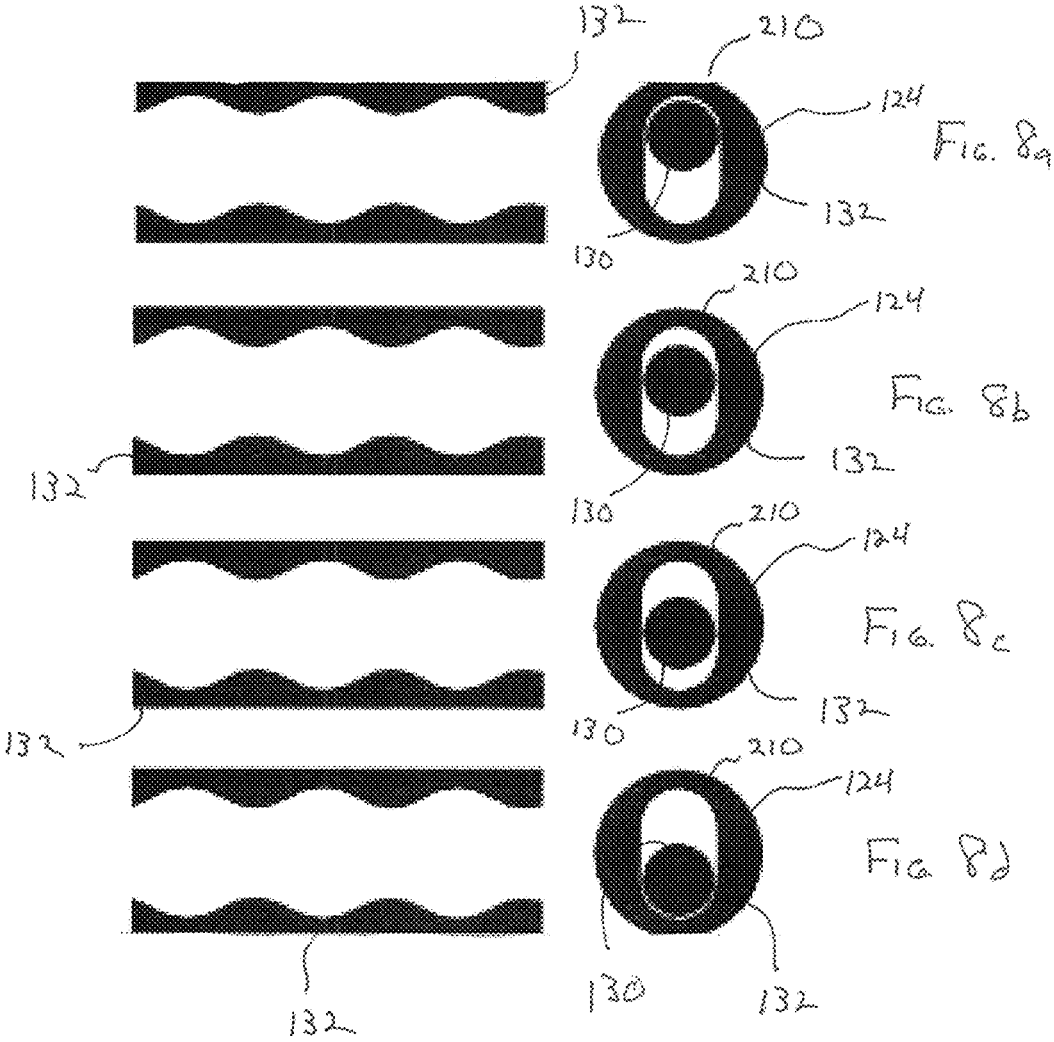
FIGS. 8*a*, 8*b*, 8*c* and 8*d* sequentially illustrate a linear oscillation pattern for a progressing motor having a 1:2 configuration.
Figures 9A, 9B, 9C, 9D:
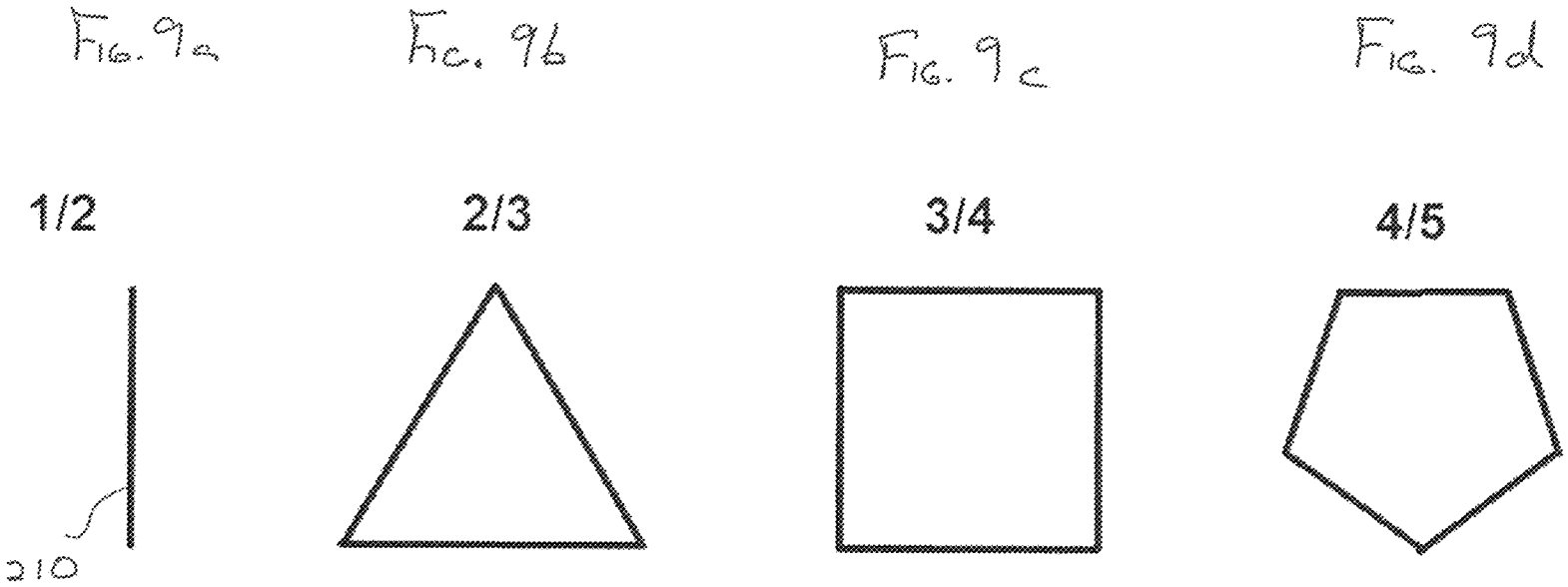
FIG. 9*a* illustrates an oscillation pattern for a progressing motor having a 1:2 configuration.
FIG. 9*b* illustrates an oscillation pattern for a progressing motor having a 2:3 configuration.
FIG. 9*c* illustrates an oscillation pattern for a progressing motor having a 3:4 configuration.
FIG. 9*d* illustrates an oscillation pattern for a progressing motor having a 4:5 configuration.

Referring to FIGS. 4, 5 and 8, progressing cavity motor 124 generally comprises a rotor member 130 and a stator member 132. The stator member 132 can be fabricated of elastomers such as, for example, Viton rubber or alternatively, the stator member 132 can be formed of rigid materials such as, for example, polymers such as high density polyethylene or metals such as stainless steel and aluminum. The rotor member can be injection molded using a suitable polymer but it is often made from a metal such as stainless steel or aluminum. Rotor member 130 generally includes one or more lobes 134 while stator member 132 generally comprises two or more cavities 136. (If "n" equal the number of lobes 134, "n+1" equal the number of cavities 136). Generally, the rotor member 130 defines a rotor inlet 138 and a rotor outlet 140. Rotor inlet 138 is fluidly interconnected to the fluid inlet 110.

Figure 11A:
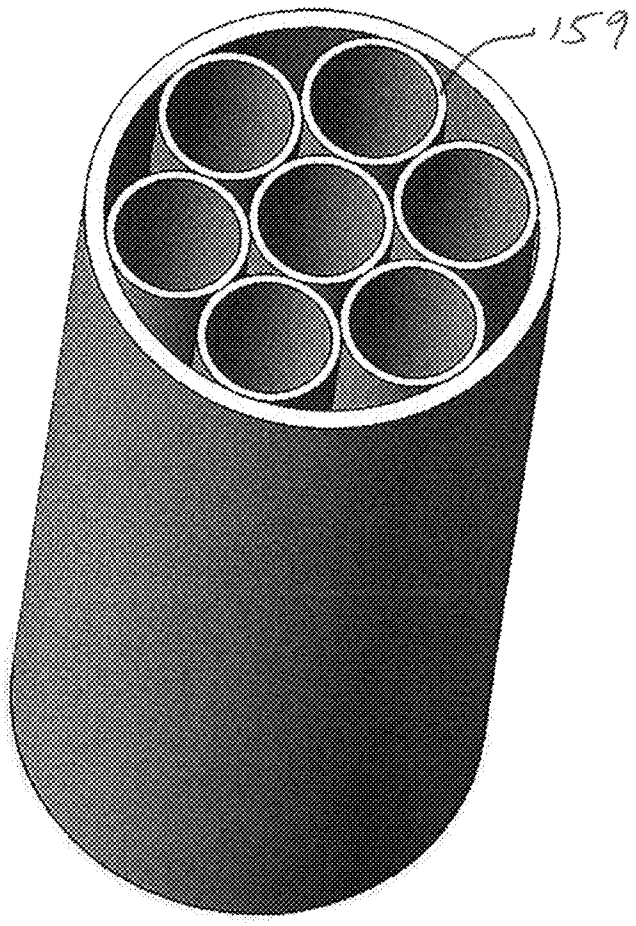
FIG. 11*a* is a perspective end view of a flow straightener according to an embodiment of the present invention.
Figure 11B:
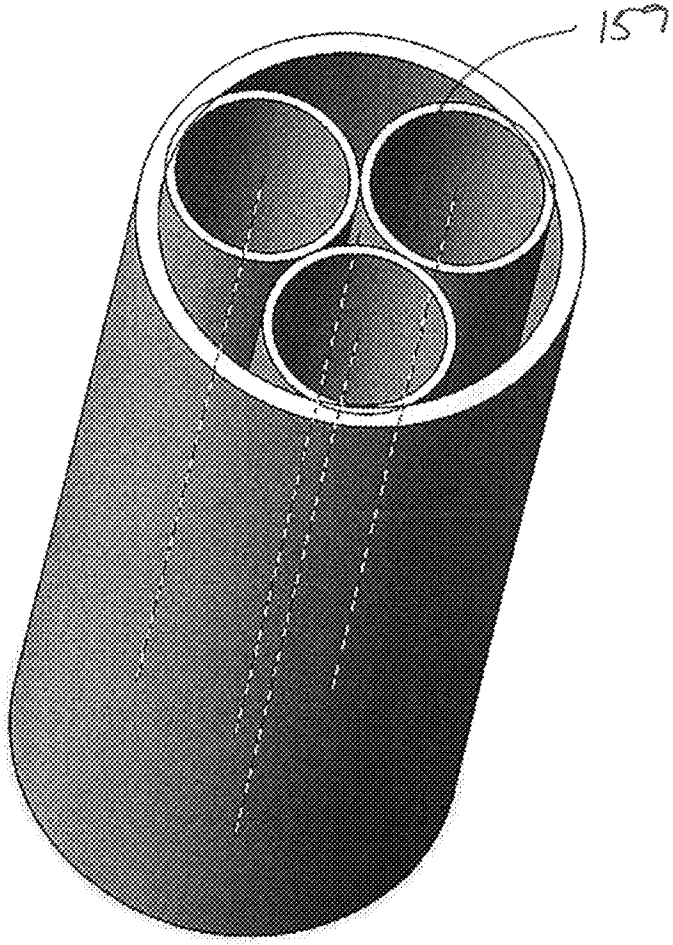
FIG. 11*b* is a perspective end view of a flow straightener according to an embodiment of the present invention.

As seen in FIGS. 4, 5, 6 and 7, spray nozzle 126 generally comprises a nozzle body 150 having a bearing holder 152, a nozzle inlet 154, a nozzle lumen 156, a nozzle outlet 158 and a nozzle bearing 161. Nozzle outlet 158 can comprise various configurations and cross-sections depending on a desired shape of a spray stream. For example, the nozzle outlet 158 can comprise a "zero nozzle", often having a round cross-section to create a "round" shaped spray stream, or alternatively, a "fan nozzle" having an elongated cross section to create a "fan" shaped spray stream. Many other nozzle shapes are available and can be easily used in the present invention by merely changing the shape or size of nozzle outlet 158. Bearing holder 152 can define a bearing seat 160, for example, a spherical bearing seat. Nozzle lumen 156 can include one or more flow straighteners 157. Each flow straightener can include one or more flow channels 159, for example, a first flow straightener 157*a* having seven flow channels 159 and a second flow straightener 157*b* having three flow channels 159 as seen in FIGS. 11*a* and 11*b*. Each flow straightener 157 is used to provide an internal flow path and to promote laminar flow through the nozzle lumen 156 and out the nozzle outlet 158 to provide a more consistent spray from the nozzle outlet 158. A bearing member 162 can include a spherical bearing 164 and a bearing tip 166. Bearing member 162 can operably/mechanically couple the progressing cavity member 124 by positioning the bearing tip 166 in the rotor outlet 140 and the spherical bearing 164 in the bearing seat 160. In this manner, any motion experienced by the rotor member 130 is imparted to nozzle body 150. Nozzle bearing 161 can fluidly seal against a tip bearing seat 170 that is mounted in the outlet aperture 112 so as to prevent fluid bypass of the spray nozzle 126.

In operation, a stream of pressurized fluid 200 is supplied to the fluid inlet 110. In many situations, pressurized fluid can comprise water though in certain cleaning, rinsing, foaming and sanitization applications, the pressurized fluid can comprise an aqueous solution including a suitable chemical. Generally, pressurized fluid 200 is supplied at a pressure close to a desired outlet pressure of a nozzle spray 202. Pressurized fluid 200 enters the rotor member 130 and interfaces with the one or more lobes 134, which causes the rotor member 130 to "rotate" within the cavities 136 of the stator member 132. As the progressing cavity motor 124 is a positive displacement motor, the speed at which the rotor member 130 oscillated is directly related to the flow conditions of the pressurized fluid 200. The only "power output" of the progressing cavity motor is the oscillating motion that is subsequently transferred to the spray nozzle 126 such that there is very little pressure differential between the rotor inlet 138 and the rotor outlet 140.

As the rotor member 130 rotates within the stator member 132, the bearing tip 166 in the rotor outlet 140 is caused to oscillate. This oscillation is communicated to the spray nozzle 126 through the interaction of the spherical bearing 164 and the bearing holder 152. As the nozzle body 150 is caused to oscillate within the nozzle section 122, the pressurized fluid 200, which has experienced very little pressure drop through the progressing cavity motor 124, enters the nozzle inlet 154. The pressurized fluid 200 flows sequentially through the flow straighteners 157*a*, 157*b* and their flow channels to eliminate turbulence and to provide a laminar flow to the nozzle lumen 156. From the nozzle lumen 156, the pressurized fluid 200 flows into and out of the nozzle outlet 158, and consequently the outlet aperture 112, as the nozzle spray 202. Engagement of the nozzle bearing 161 and the tip bearing seat 170 prevents any of the pressurized fluid 200 from bypassing the spray nozzle 126 such that there is no leakage from the outlet aperture 112, i.e., no bypass of the nozzle outlet 158.

Oscillating spray nozzle 100 of the present invention allows for customization of the spray pattern of nozzle spray 202. For example, a back and forth, linear oscillation 210 can be communicated to the spray nozzle 126 by using a progressing cavity motor 124 with a 1:2 configuration (rotor member 130 having one lobe 134: stator member 132 having two cavities 136). The oscillation pattern of 1:2 linear oscillating progressing cavity motor 124 is illustrated sequentially in FIGS. 8*a*, 8*b*, 8*c* and 8*d*. Oscillation patterns associated with progressing cavity motors having various lobe: cavity configurations are illustrated in FIGS. 9*a*, 9*b*, 9*c* and 9*d*. By customizing the oscillation pattern along with the selection of the nozzle outlet 158, the performance of the oscillating spray nozzle 100 can be optimized and tailored for specific application, whether it be applying or removing foam from a car in a car wash setting or whether it be digging/cutting straight lines in a hydroexcavation setting.

Oscillating spray nozzle 100 of the present invention also allows for repair or reconfiguration of the oscillating spray nozzle 100 through the disassembly of the housing 102 whereby various components can be replaced. For example, a user could change the oscillation pattern by removing and replacing the rotor member 130 and stator member 132 so as to have different lobe:cavity configurations. Alternatively, the user can replace the spray nozzle 126 to have a different nozzle outlet 158, whereby the shape of the nozzle spray 202 is changed. Alternatively, the same oscillating and spray performance can be maintained but elements can be replaced as they wear due to wear, chemical compatibility issues or the like.

Oscillating spray nozzle 100 can allow for further adjustment in oscillation speed by controlling flow through the progressing cavity motor 124. For example, stator member 132 is generally fluidly sealed to housing 102 such that all of the pressurized fluid 200 supplied to fluid inlet 110 is directed through the stator member 132 as opposed to around the stator member, i.e., between the stator member 132 and the housing 102. Alternatively, pressurized fluid 200 can be allowed to partially bypass the stator member 132 and flow between the stator member 132 and the housing 102 such that the rotor member 130 does not interface with all of the pressurized fluid 200. In this manner, the oscillation speed of the rotor member 130 and consequently, the spray nozzle 126 can be reduced. Bypass flow around the stator member 132 could be metered by passing the bypass flow through a passage of known volume that is formed between the stator member 132 and the housing 102. Alternatively, the fluid inlet 110 could include an adjustable orifice allows in the oscillation speed of the progressing cavity motor 124 to be adjusted. Furthermore, oscillation speed can be controlled by changing the volume of the progressing cavity motor 124.

Figure 10:
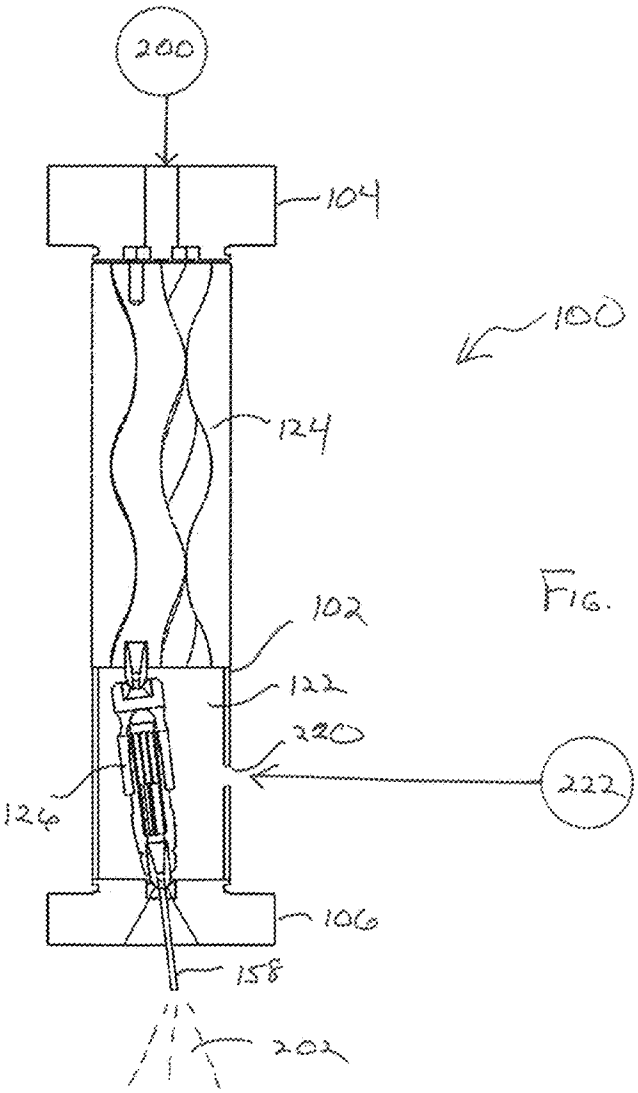
FIG. 10 is a section view of an oscillating spray nozzle according to a representative embodiment of the present invention.

In another embodiment, oscillating spray nozzle 100 can include one or more chemical inlets 220 that extends through the housing 102 and into the nozzle section 122 as shown in FIG. 10. This can allow for the mixing of an additional fluid/chemical 222 into the pressurized fluid 200 prior to being dispensed from the nozzle outlet 158 as nozzle spray 202. The additional fluid/chemical can include air or a foaming agent to provide a foaming action in a car wash. In another representative embodiment, chemical inlet 220 can include a venturi configuration whereby the additional fluid/chemical is drawn into the nozzle section 122.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents.

The invention claimed is:

1. An oscillating nozzle, comprising:

a housing defining a fluid inlet and an outlet aperture, the housing defining a motor section and a nozzle section;

a progressing cavity motor positioned within the motor section, the progressing cavity motor comprising a rotor member positioned within a stator member, the rotor member including at least one rotor lobe and the stator member including at least two stator cavities; and a spray nozzle mounted within the nozzle section, the spray nozzle including a nozzle body having a nozzle inlet and a nozzle outlet, a bearing member operably coupling a rotor outlet on the rotor member to the nozzle body; wherein the nozzle housing defines a bearing seat; and the bearing member defines a bearing tip and a spherical bearing, the bearing tip operably positioned within the rotor outlet and the spherical bearing mounted within the bearing seat;

wherein the rotor member is fluidly interconnected to the fluid inlet such that a pressurized fluid causes the rotor member to oscillate within the stator member; and the spray nozzle is operably coupled to the rotor member such that oscillation of the rotor member causes the nozzle body to oscillate such that a nozzle spray dispensed from the outlet aperture shares an oscillation pattern of the rotor member.

2. The oscillating nozzle of claim 1, wherein the housing further comprises an inlet cap and an outlet cap, the inlet cap including the fluid inlet and the outlet cap including the outlet aperture.

3. The oscillating nozzle of claim 2, wherein the inlet cap and the outlet cap are removably attached to the housing.

4. The oscillating nozzle of claim 1, wherein the housing includes a chemical inlet in the nozzle section, the chemical inlet allowing for mixing of a chemical into the pressurized fluid to create a solution for dispensing through the nozzle outlet.

5. An oscillating nozzle, comprising:

a housing defining a fluid inlet and an outlet aperture, the housing defining a motor section and a nozzle section;

a progressing cavity motor positioned within the motor section, the progressing cavity motor comprising a rotor member positioned within a stator member, the rotor member including at least one rotor lobe and the stator member including at least two stator cavities, wherein the stator member is fluidly sealed to the housing such that all of the pressurized fluid is directed to the rotor member; and a spray nozzle mounted within the nozzle section, the spray nozzle including a nozzle body having a nozzle inlet and a nozzle outlet, wherein the rotor member is fluidly interconnected to the fluid inlet such that a pressurized fluid causes the rotor member to oscillate within the stator member; and wherein the spray nozzle is operably coupled to the rotor member such that oscillation of the rotor member causes the nozzle body to oscillate such that a nozzle spray dispensed from the outlet aperture shares an oscillation pattern of the rotor member.

6. The oscillating nozzle of claim 1, wherein a portion of the pressurized fluid bypasses the rotor member and flows between the stator member and the housing.

7. The oscillating nozzle of claim 1, wherein a ratio of rotor lobes to stator cavities is 1:2 such that the oscillation pattern is a linear, side to side oscillation pattern.

8. The oscillating nozzle of claim 1, wherein a ratio of rotor lobes to stator cavities is 2:3 such that the oscillation pattern is a triangular oscillation pattern.

9. The oscillating nozzle of claim 1, wherein a ratio of rotor lobes to stator cavities is 3:4 such that the oscillation pattern is a square oscillation pattern.

10. The oscillating nozzle of claim 1, wherein the spray nozzle further comprises one or more flow straighteners for inducing laminar flow conditions at the nozzle outlet.

11. The oscillating nozzle of claim 10, wherein each flow straightener comprises a plurality of flow channels.

12. An oscillating nozzle, comprising, a housing defining a fluid inlet and an outlet aperture, the housing defining a motor section and a nozzle section;

a progressing cavity motor positioned within the motor section, the progressing cavity motor comprising a rotor member positioned within a stator member, the rotor member including at least one rotor lobe and the stator member including at least two stator cavities; and a spray nozzle mounted within the nozzle section, the spray nozzle including a nozzle body having a nozzle inlet and a nozzle outlet, wherein the spray nozzle further comprises one or more flow straighteners for inducing laminar flow conditions at the nozzle outlet and each flow straightener comprises a plurality of flow channels, wherein a first flow straightener has a greater number of flow channels than a second flow straightener and wherein flow is sequential from the nozzle inlet, through the first flow straightener to the second flow straightener and out the nozzle outlet, wherein the rotor member is fluidly interconnected to the fluid inlet such that a pressurized fluid causes the rotor member to oscillate within the stator member; and the spray nozzle is operably coupled to the rotor member such that oscillation of the rotor member causes the nozzle body to oscillate such that a nozzle spray dispensed from the outlet aperture shares an oscillation pattern of the rotor member.

13. A hydroexcavation system, comprising the oscillating nozzle of claim 1.

14. A car wash, comprising the oscillating nozzle of claim 1.

15. The oscillating nozzle of claim 1, wherein the stator member is fluidly sealed to the housing such that all of the pressurized fluid is directed to the rotor member.

16. The oscillating nozzle of claim 11, wherein a first flow straightener has a greater number of flow channels than a second flow straightener and wherein flow is sequential from the nozzle inlet, through the first flow straightener to the second flow straightener and out the nozzle outlet.

17. The oscillating nozzle of claim 5, wherein the housing further comprises an inlet cap and an outlet cap, the inlet cap including the fluid inlet and the outlet cap including the outlet aperture.

18. The oscillating nozzle of claim 5, wherein the housing includes a chemical inlet in the nozzle section, the chemical inlet allowing for mixing of a chemical into the pressurized fluid to create a solution for dispensing through the nozzle outlet.

19. The oscillating nozzle of claim 5, wherein the spray nozzle further comprises one or more flow straighteners for inducing laminar flow conditions at the nozzle outlet.

20. The oscillating nozzle of claim 12, wherein the housing further comprises an inlet cap and an outlet cap, the inlet cap including the fluid inlet and the outlet cap including the outlet aperture.

21. The oscillating nozzle of claim 12, wherein the housing includes a chemical inlet in the nozzle section, the chemical inlet allowing for mixing of a chemical into the pressurized fluid to create a solution for dispensing through the nozzle outlet.

22. The oscillating nozzle of claim 12, wherein the spray nozzle further comprises one or more flow straighteners for inducing laminar flow conditions at the nozzle outlet.

* * * * *